United States Patent [19]

Lindauer

[11] 4,449,987

[45] May 22, 1984

[54] FRAGRANT INSECT REPELLENT COMPOSITION AND COMBUSTIBLE CANDLE COMPOSITION CONTAINING SAME

[75] Inventor: Jerome I. Lindauer, Hillsdale, N.J.

[73] Assignee: Avon Products, Inc., New York, N.Y.

[21] Appl. No.: 458,891

[22] Filed: Jan. 18, 1983

Related U.S. Application Data

[63] Continuation-in-part of Ser. No. 316,150, Oct. 29, 1981, abandoned.

[51] Int. Cl.[3] ..... C11C 5/00; C10L 5/00

[52] U.S. Cl. ..... 44/7.5; 252/522 A; 424/40; 431/288

[58] Field of Search ..... 44/7.5; 431/288; 424/40; 252/552 A

[56] References Cited

U.S. PATENT DOCUMENTS

| | | | |
|---|---|---|---|
| 2,529,245 | 11/1950 | Cooper | 44/7.5 X |
| 2,918,750 | 12/1959 | Blatt | 44/7.5 X |
| 3,615,289 | 10/1971 | Felton | 44/7.5 |
| 3,645,705 | 2/1972 | Miller et al. | 44/7.5 |
| 3,898,039 | 8/1975 | Lin | 44/7.5 X |

OTHER PUBLICATIONS

"Intrinsic Mosquito Repellency Values of Some Chem. Compounds" by Burton, vol. 84, *Amer. Perfumer & Cosmetics*, p. 41, (1946).

*Primary Examiner*—Carl F. Dees
*Attorney, Agent, or Firm*—Arthur L. Liberman

[57] ABSTRACT

Described are candle compositions which may be opaque or transparent or pastel shaded which are adapted to incorporate compositions which are both perfumes and insect repellents, without flashing during burning, such compositions comprising as the basic components a mixture of (a) a hydrocarbon wax or (b) a thermoplastic polyamide resin formed from linoleic acid polymerized with a polyamine compound taken together with an alkanol amide or alkanol amine and a stearic acid compound or (c) a straight chain aliphatic amide in combination with light mineral oil and alcohol; compositions (a), (b) or (c), supra, taken further together with a mixture containing:

From 1–30 parts by weight of a methyl heptenone;
From 1–10 parts by weight of coumarin; and
From 0.4–15 parts by weight of indole;

taken alone or taken together with a perfume composition substantially inactive from an insect repellent standpoint.

10 Claims, No Drawings

FRAGRANT INSECT REPELLENT COMPOSITION AND COMBUSTIBLE CANDLE COMPOSITION CONTAINING SAME

This application is a continuation-in-part of application for United States Letters Patent, Ser. No. 316,150 filed on October 29, 1981 and now abandoned.

BACKGROUND OF THE INVENTION

This invention relates to materials suitable for candle bodies which candle bodies include compositions of matter which are both (i) efficaciously insect repelling and (ii) perfuming in an aesthetically pleasing manner on use thereof.

Formulations exist in commerce which are said to provide candle body materials that are both perfuming and insect repellent but such formulations have yielded a candle body that is either insufficiently insect repellent or aesthetically displeasing from an organoleptic standpoint.

When a candle burns, the heat of its flame melts a small pool of the candle body material around the base of the exposed portion of the wick, and this molten material is drawn up through the wick by capillary attraction to fuel the flame. Thus the process that takes place in the burning of a candle imposes rather stringent functional requirements upon the candle body material.

The material of a candle body must be rigid enough to support itself and a relatively long wick filament, but it should not be excessively brittle at low temperatures. Its melting point is critical, in that it should liquify temperatures, to which, it can be raised by radiant heat from the candle flame. If its melting temperature is too low, the candle will drip or, in an extreme case, the entire candle body will melt, dropping the wick into a pool of molten material with the hazardous possibility that the surface of the pool will iqnite when this happens. If too high a temperature is required to melt the body material, the flame will be starved because insufficient fuel will be drawn up through the wick, with the result that the flame will be too small to maintain itself. When molten, moreover, the candle body material must have a relatively low viscosity in order to insure that it will be capable of being drawn up through the wick by capillary action.

In addition to meeting these requirements the candle body material must burn with a flame that is both luminous and smokeless and such odors as are produced by its combustion should not be unpleasant and should preferably be faint.

The functional requirements outlined above have, of course, been met by various candle body materials that are well known in the art, but heretofore no known materials that meets these requirements has been both:

(a) Perfuming to the environment surrounding the burning candle; and (b) Adequately insect repellent to the environment surrounding the material at various environmental temperatures at atmospheric pressure, from a temperature of about 0° C. up to a temperature of about 50° C.

However, the desire for such a candle body material which is either transparent, opaque or translucent has long persisted where the candle composition is both insect repellent and perfuming on use.

An article by Burton, "Intrinsic mosquito repellency values of some chemical compounds" appearing in Volume 84, *American Perfumer and Cosmetics,* April, 1969 at page 41, indicates that Coumarin has a value of from 0.001 up to 0.003 micromoles per liter of air for 90% insect repulsion. It further states that Indole has a property such that 0.004 up to 0.01 micromoles per liter of air of Indole are needed for 90% insect repulsion. On the other hand the article by Burton indicates that a compound such as Linalool requires 0.1 micromoles per liter of Linalool per liter of air for 90% insect repulsion.

Nothing is stated in the Burton article which causes one to be taught that Coumarin and Indole taken in combination can be added to citronella oil or one or more methyl heptenones whereby the efficacy of the overall composition is maintained or increased and the overall concentration of insect repelling mixture is substantially diminished while at the same time causing an aesthetically pleasing aroma to be emanated from the burning candle on use.

Currently on the market are "citronella oil candles" containing approximately 1.5–3% citronella oil. On use these candles give off an essentially aesthetically displeasing aroma and are not quite as effective in repelling insects as desired by the user.

U.S. Pat. No. 3,615,289 issued on Oct. 26, 1971 discloses candle compositions which may be transparent or pastel shaded which are adapted to incorporate perfumes without flashing during burning, and such compositions comprise as the basic components the mixture of (i) a thermoplastic polyamide resin formed from linoleic acid polymerized with a polyamine compound; (ii) an alkanol amide or alkanol amine; and (iii) a stearic acid compound. More Specifically, U.S. Pat. No. 3,615,289 specifically discloses and claims a candle composition comprising about 15 to 35% by weight of a solid gel thermoplastic polymer which is a solid polyamide resin which is the soluble condensation product of an aliphatic dicarboxylic acid and an amine, the carboxyly and amino groups of adjacent mono units being condensed to an amide linkage in the polymer (and the resin may also be based on carboxylic and amine compounds having more than two carboxyl and amino groups respectively). At column 3, line 10 of U.S. Pat. No. 3,615,289 it is indicated that the candle contain about 0.4% by weight of a perfume material. Claim 3 at column 4 of U.S. Pat. No. 3,615,289 discloses a composition wherein 5 to 7% of the composition is replaced by a coumarone-indene copolymer resin. The insect repellency of compositions usable in U.S. Pat. No. 3,615,289 is not disclosed however.

U.S. Pat. No. 3,645,705 discloses a transparent candle body composition of matter which can contain:

(a) From about 35% up to about 85% by weight of an oil which is normally liquid at room temperature which may be light mineral oil and a natural oil;

(b) From about 7% up to about 40% by weight of a long chain polyamide having a molecular weight between 6,000 and 9,000 and a softening point within the range of 185° C.–48° C. from about 7% up to about 30% by weight of an alcohol which may be a $C_8$ up to a $C_{12}$ primary alcohol.

At column 3, line 56 of U.S. Pat. No. 3,645,705 it is disclosed that an odor masking agent may be incorporated into the candle composition. Generally this disclosure is set forth at lines 30–44 of U.S. Pat. No. 3,645,705 thusly:

"The inclusion in the composition of certain alcohols that produce otherwise desirable properties may result in a material that burns with an acrid or pungent odor.

In such cases a small amount of an odor masking agent can be incorporated in the composition. The material sold by Fritzsche, Dodge and Olcott as its No. 41984 has been found satisfactory when incorporated in the composition in amounts up to about 0.2 percent by weight. The odor-masking agent is desirable when less expensive alcohols are used and may be unnecessary if the alcohols are highly refined, but from the standpoint of cost, the use of the cheaper alcohols and an odor-masking agent is indicated and produces satisfactory results. If desired, a small amount of perfume can be added to the composition to complete the odor-masking effect."

Nothing in U.S. Pat. No. 3,645,705, however, discloses the applicability to the composition disclosed therein of insect repellent materials. Nothing discloses the use of a composition of matter in U.S. Pat. No. 3,645,705 which will be both a perfumant and an insect repellent.

U.S. Pat. No. 4,051,159 issued on Sept. 27, 1977 discloses a "shaped, self-supporting transparent fragrance emitting article comprising a high percentage of a thermoplastic polyamide resin having substantially uniformly dispersed therein a $C_{14}$–$C_{22}$ alkyl alcohol and a fragrance emitting material". U.S. Pat. No. 4,051,159 however, does not indicate that the compositions of matter disclosed therein are useful for the purposes of candles and particularly are useful for fragrant candles or insect repellent candles or candles which are both fragrance emitting and insect repellent.

Published Japanese patent application J57088-101 assigned to the Agency of Industrial Sci. Tech. of Japan discloses the use of benzal acetone, 1-carvone thymol as insect repelling materials contained in conjunction with an aromatic substance, silica gel, talc or a binder such as polyvinyl alcohol or carboxymethyl cellulose.

Published Japanese patent application 57088-101 however, does not indicate that compositions of matter are useful for the purposes of candles and particularly, are useful for fragrant candles or insect repellent candles or candles which are both fragrancy emitting and insect repellent in an efficacious manner. The abstract of published Japanese application J57088-101 is as follows:

> Insect repellent contains benzalacetone (I) as active component. (I) has an immediate effect used in combination with sublimating substance such as naphthalene and camphor. The ratio of blend of benzalacetone to the sublimating substance is 90:1–5:95. Opt. excipient such as silica gel, talc and binder such as PVA or CMC. and aromatic substance can be added (I) can be put in a suitable vessel, can be prepd. as tablet, or can be supported on cloth or paper.

Benzalacetone has the m.pt. of 41–42 deg.C and the b.pt. of 260–262 deg.C. The satd. gas concn. of benzalacetone is 0.045 mg/l by gas chromatography and is one tenth that of 1-carvone and one third that of thymol, and therefore it has long-lasting effect.

(I) is nontoxic to warm-blooded animals, and shows repelling effect for a long period of time. It is prepd. in low cost, and can be stored in plastic vessel, since it does not etch plastics. It is particularly effective in the repelling of insects for clothes, e.g. Tinea pellionella. (3pp)

OBJECTS OF THE INVENTION

The present invention has as its object to provide a candle body material which possesses all of the necessary functional characteristics and which, moreover, is both insect repelling and perfuming on use, having an aesthetically pleasing aroma on use and having efficacious insect repellent properties on use, which insect repelling properties are at least equivalent to candles containing standard concentrations of citronella oil but which contain much lesser concentrations of citronella oil than the standard citronella candles.

It is another object of this invention to provide an insect repelling-perfuming candle body material which possesses all of the necessary functional characteristics and which, moreover, is truly transparent.

It is also an object of this invention to provide an insect repelling-perfuming candle body material which has the transparency of glass, with no cloudiness or opacity whatsoever and which can be colored if desired or can be left uncolored so that it can be formed into candles having the clear, sparkling esthetic qualities of fine glassware.

Another object of this invention is to provide a perfuming-insect repelling (on use) transparent material which is in a gel phase and which is combustible with a luminous, smokeless flame and passes into a low viscosity liquid phase at temperatures on the order of those near the base of the flame produced by the combusting material.

THE INVENTION

This invention relates to candle body materials which, on use, are both insect repelling and perfuming and which, although containing low concentrations of methyl heptenones or citronella oil than contained in currently available candles are (i) at least efficacious as such candles and (ii) emit an aesthetically pleasing scent on burning.

The insect repellent-perfuming compositions which form part of the candle body materials are within the following specifications:

(I) From 5 up to 100% by weight of an efficacious perfuming/insect repelling composition consisting essentially of:

(a) from 1–30 parts by weight of a methyl heptenone, for example, 2-methyl-3-hepten-5-one having the structure:

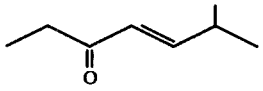

or a methyl heptenone having one of the following structures:

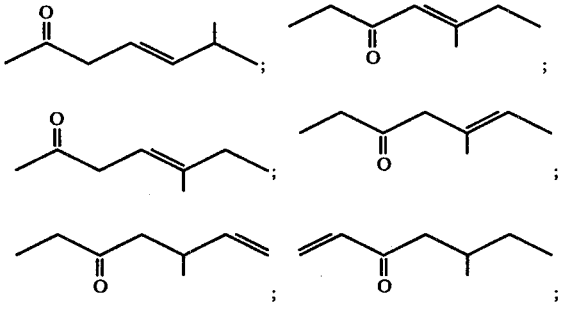

-continued

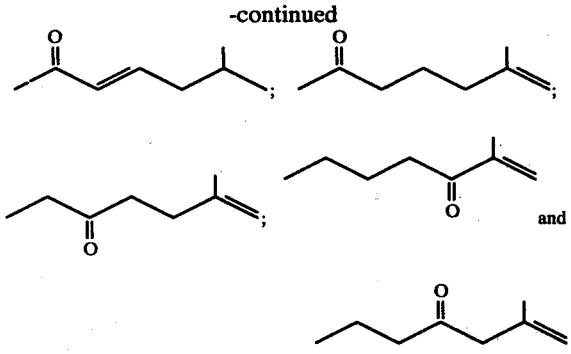

(b) from about 1 up to about 10 parts by weight of Coumarin;

(c) from about 0.4 up to about 15 parts by weight of Indole; and (II) From 0 up to 95% by weight of a standard perfuming substance (non-insect-repelling) which may be one or a combination of the following materials:

the methyl ester of 2,5-dihydroxy-4,6-dimethyl benzoic acid;
dihydro myrcenol;
oakmoss absolute;
benzyl acetate;
geraniol,
isobornyl acetate;
citronellyl acetate;
para-t-butyl phenyl isovaleraldehyde;
benzyl salicylate;
hexyl cinnamic aldehyde;
geranonitrile;
patchouli oil;
alpha-terpineol
tetrahydromuguol;
phenyl ethyl alcohol;
cedrenal;
methyl ionone;
cinnamyl acetate;
benzyl benzoate;
L-Citronellal;
Nerol;
Geranyl formate;
Geranyl acetate;
Eugenol;
Alpha Farnesene;
Beta Farnesene;
Citral;
n-Nonanal;
n-Octanal;
Trans,trans delta-damascone The foregoing formula may require a solubilizing agent, e.g., the methyl ester of dihydroabieteic acid (commercial name: Hercolyn D®), benzyl benzoate, isopropyl myristate and/or $C_{12}$–$C_{14}$ isoparaffin hydrocarbons.

The candle base composition can be standard paraffin wax, or it can be transparent or pastel shaded as more particularly described in U.S. Pat. No. 3,615,289 issued on Oct. 26, 1971 (the disclosure of which is incorporated by reference herein) and wherein the candle body comprises as the basic components a mixture of:

(i) A thermoplastic polyamide resin formed from linoleic acid polymerized with a polyamine compound;

(ii) An alkanol amide or alkanol amine; and (iii) A stearic acid compound.

The weight ratio of candle body: Insect repellent-/perfumant substance of my invention may vary from about 0.8% up to about 10% with a range of from about 0.8% up to about 2.0% being preferred when no non-insect repelling perfume oil is used in conjunction with the coumarin-indole-methylheptenone substance; and with a range of from about 1.5% up to about 10% by weight of the overall composition being preferred when a non-insect repelling perfume oil is used in conjunction with the coumarin-indole-methylheptenone substance.

Specifically, the polyamid resin may be a "Versamid" resin which is a thermoplastic condensation product of polymerized linoleic acid with various polyamine compounds such as ethylene diamine, ethylene triamene and the like. Specific "Versamid" compounds are "Versamid®900", "Versamid®930", "Versamid®940", "Versamid®948", "Versamid®950" and "Versamid®1635". These compounds are products of the Henkel Chemical Corporation of Minneapolis, Minn.

Another substance required in the clear candle composition consists of about 20–55% by weight of an alkanol amine or alkanol amide prepared by the reaction of a fatty acid ester and amine whereby the ester and the amine are in substantial equal proportions, for example, compounds such as Barlol 12C2 (manufactured by the Barrid Chemical Company) a monoalkyl diethanolamine have 8 to 18 carbon atoms in the alkyl chain. A third component of the clear plastic candle composition comprises one or more stearic acid esters or a mixture of stearic acid esters and stearic acid. These esters include such compounds as isopropyl isostearate, butyl stearate and hexadecyl stearate. These stearic acid compounds serve as stabilizing agents which permit the ready incorporation of the insect repellent/perfumant compositions of our invention up to a level of approximately 5% (total proportion of perfume oil-insect repellent composition). They are carriers for the perfumant/insect repellent and may be used in a proportion of between 1 and 50% by weight of the composition although the preferable range is between about 20 to 30%. In this connection it is possible to use up to about 10% by weight of perfumant/insect repellent if part of the formula is replaced by the material "Nevex 100", a product which is a coumarone-indene copolymer resin of very little unsaturation, manufactured by the Neville Chemical Company.

Rather than being a crystalline paraffin wax the candle base of my invention may be an oil gel that has as its base a light mineral oil, an inexpensive natural oil or a combination of such oils which oil gel has a non-greasy surface and feel and sufficient rigidity to be self-supporting at room temperatures. Such a gel is disclosed in U.S. Pat. No. 3,645,705 issued on Feb. 29, 1972, the disclosure of which is incorporated by reference herein. Such compositions of matter include:

(a) from about 35% up to about 85% by weight of an oil which is normally liquid at room temperature chosen from the group consisting of light mineral oil and natural oils having iodine values substantially within the range of 40–135;

(b) from about 7% to about 40% by weight of a long chain polyamide having a molecular weight substantially within the range of 6000–9000 and a softening point substantially within the range of 185° C.–48° C.; and (c) from about 7% to about 30% of an alcohol selected from the group consisting of 8 to 12 carbon primary alcohols.

Such composition may additionally include from about 1% up to about 15% of a methyl ester; up to about 5% by weight of stearic acid and up to about 5% by weight of an oxidation inhibiting agent and up to about 5% by weight of an acid selected from the group consisting of dimer and trimer acids.

The following examples are illustrative of specific embodiments and it is not intended that the invention be limited thereto.

EXAMPLE I

PARAFFIN WAX CANDLE BODY

The following composition is prepared:

| Ingredients | Parts by Weight |
|---|---|
| Paraffin wax | 95.0 |
| Perfuming-insect repelling composition which contains 19.0 parts of 2-methyl-3-heptene-6-one 3.3 parts Coumarin and 0.3 parts Indole | 5.0 |

The paraffin wax is intimately admixed at 150° C. and 10 atmosphere pressure with the mixture of methyl heptenone coumarin and indole in an autoclave with intensive shaking. The autoclave pressure is maintained with a nitrogen atmosphere. At the end of a period of 1 hour the autoclave is depressurized, the autoclave is opened and the resulting mixture is poured into cylindrical candle molds containing wicks.

The resulting candles on use evolve an aesthetically pleasing aroma and, in addition, give rise to efficacious insect repellency. The candles are effective in preventing mosquitos from entering a room in which one candle is burning for a period of 10 minutes, the said room having dimensions of 6'×15'×15' having a 3'×3' open portal adjacent to a mosquito-laden swamp in the month of August in the temperature zone.

EXAMPLE II

A transparent candle base mixture is produced by intimately admixing the following ingredients:

| | Parts by Weight |
|---|---|
| Versamid ® 1635 | 34.0 |
| Barlol 12C2 | 51.0 |
| Butyl Stearate | 3.5 |
| Nevex ® 100 | 5.0 |
| Span ® 60 | 1.5 |
| Isopropyl Isostearate | 4.0 |
| Isopropyl Myristate | 4.0 |

The foregoing mixture is placed in an autoclave and intimately admixed with a perfuming-insect repellent composition containing the following ingredients:

| | Parts by Weight |
|---|---|
| 3-methyl-4-heptene-6-one | 18.0 |
| Coumarin | 1.0 |
| Indole | 1.0 |

at the rate of 8% by weight of the total candle base composition.

The autoclave is sealed and heated to 180° C. under 15 atmospheric pressure and maintained with vigorous shaking for a period of 5 hours. At the end of the 5 hour period the autoclave is depressurized (being under a nitrogen pressure atmosphere) and the autoclave is opened and the contents are then poured into cylindrical candle molds four inches in height and two inches in diameter containing 0.125" wicks. The resulting candles have efficacious insect repellenices and have aesthetically pleasing aromas on use.

The candles are effective in preventing mosquitos from entering a room in which two candles have been burning for 15 minutes, the said room having dimensions of 6'×15'×15' and having a 3'×3' open portal adjacent a mosquito-laden swamp in the month of August, in the temperate zone.

EXAMPLE III

The following candle base composition of matter is prepared:

| Ingredients | | Parts by Weight |
|---|---|---|
| Polyamide (Versamid ® 940 manufactured by the Henkel Chemical Corporation of Minneapolis, Minnesota) | | 30.0 |
| Stearic acid | | 5.0 |
| Methyl-12-hydroxy stearate | | 5.0 |
| 10 Carbon primary alcohol (Continental Oil Company Alfol 10) further (Alfol ® is a trademark of Conoco Division of E. I. DuPont of Wilmington, Delaware) | | 5.0 |
| Myristyl Myristate | | 10.0 |
| Stearic hydrazide | | 0.1 |
| Perfumant insect repellent composition This composition contains the following ingredients: | | 4.0 |
| 2-methyl-1-heptene-3-one | 4.0 | |
| Coumarin | 2.0 | |
| Indole | 2.0 | |
| Light white mineral oil | | q.s. to 100% |

All of the materials except the polyamide are mixed at room temperature. The mixture is then heated gradually with gradual addition of the polyamide and with aggitation beginning with the commencement of addition of the polyamide. In the proportion required, the polyamide does not become fully soluable until the mixture reaches the temperature of about 220° F. The temperature on the order of 220° F. to 230° F. is maintained at atmospheric pressure with continued aggitation until the polyamide is fully desolved. Since higher temperatures promote solution of the polyamide this temperature range can be slightly exceeded with some advantage. As soon as the polyamide has dissolved completely, the mixture is poured into molds following the conventional practice in the manufacture of molded candles. As the candles cool they harden. The candles are then freed from the molds and tested for insect repellency.

The candles are effective in preventing mosquitos from entering a room in which two candles have been burning for 15 minutes, the said room having dimensions of 6'×15'×15' and having a 3'×3' open portal adjacent a mosquito-laden swamp in the month of August in the temperate zone.

EXAMPLE IV

A study was conducted to evaluate the efficacy of candles which are designated as "A", "B" and "C" in repelling adult female mosquitos.

Candle "A" contained 95% Paraffin Wax and 5% of the following composition:

100 parts by weight of 2-methyl-3-hepten-5-one
10 parts by weight of Coumarin
1 part by weight of Indole
700 parts by weight of a perfuming composition containing the following ingredients:

| | Parts by Weight |
|---|---|
| (i) Perfume mixture of essential oils and chemicals, to wit: the methyl ester of 2,5-dihydroxy-4,6-dimethyl benzoic acid; dihydro myrcenol; oakmoss absolute; benzyl acetate; geraniol; isobornyl acetate; citronellyl acetate; para-t-butyl phenyl isovaleraldehyde; benzyl salicylate; hexyl cinnamic aldehyde; geranonitrile; patchouli oil; alpha-terpineol; tetrahydromuguol; phenyl ethyl alcohol; cedrenal; methyl ionone; cinnamyl acetate; benzyl benzoate; | 83.8 grams |
| (ii) Solvent: the methyl ester of dihydroabietic acid | 4.0 grams |

Candle "B" contained 90% Paraffin Wax and 10% citronella oil.

Candle "C" contained only Paraffin Wax.

The candles are allowed to burn for 20 minutes and the number of mosquitos repelled is recorded for the next 60 minutes with the following equipment and procedure:

Materials

Test Chamber

The evaluation was conducted in a 28.3-cub m chamber with airing ports. A screened cage measuring 15 cm×15 cm×47.5 cm was attached inside an upper airing port, and a screened repellency observation cage measuring 15 cm×15 cm×32.5 cm was attached outside the upper airing port. The two cages were held together by a Masonite plate which fit firmly in the airing port. A 4-cm hole located in the center of each Masonite plate provided an escape for the test insects. A barrier was used to close the hole.

Attractant

A caged mouse was used as an attractant and was placed inside the chamber in the larger section of the repellency cage.

Test Insect

Adult female mosquitoes, *Aedes aegypti* L., are the test insects.

Procedure

For each replicate, 75 to 100 adult female mosquitoes were removed from the rearing cage by means of a vacuum aspirator, and transferred by carbon dioxide anesthesia to the inner cage containing the mouse. The assembled cage was placed in one of the upper ventilation ports of the chamber.

For each experimental situation the test insects were transferred to a clean cage containing the mouse. A mosquito candle was placed centrally on the chamber floor and burned for 20 minutes before initiating the repellency counts. The maximum period for the repellency counts was 60 minutes. The first repellency count was made at 10 minutes after the burning ended, and subsequent counts were taken at 5-minute intervals thereafter. The number of mosquitoes repelled were those escaping to the outside cage. For the control, counts were made in a similar manner, but no candle was burned.

The same three candles were used for all four replicates. Between replicates the chamber was exhausted, the Kraft paper flooring for the chamber was replaced, and the two screened repellency cages were submerged in hot detergent water, rinsed and dried.

Results

The average percent mosquitoes repelled for each 5-minute exposure period through 60 minutes is reported in Table I.

TABLE 1

| | | Mosquitoes Repelled at Five-Minute Time Intervals (20 Minutes Post Exposure) | | | | | | | | | | | | |
|---|---|---|---|---|---|---|---|---|---|---|---|---|---|---|
| | | | Cumulative Number of Mosquitoes Repelled at Indicated Minutes | | | | | | | | | | | |
| Sample | Replicate | Number of Mosquitoes | 10 | 15 | 20 | 25 | 30 | 35 | 40 | 45 | 50 | 55 | 60 | Overall Percent |
| Untreated (no candle used) | 1 | 93 | 1 | 1 | 1 | 1 | 1 | 2 | 2 | 3 | 3 | 4 | 6 | 6.45 |
| | 2 | 67 | 0 | 1 | 2 | 3 | 5 | 6 | 6 | 6 | 6 | 7 | 7 | 10.45 |
| | 3 | 86 | 2 | 2 | 2 | 3 | 4 | 5 | 6 | 7 | 7 | 7 | 7 | 8.14 |
| | 4 | 90 | 2 | 3 | 3 | 3 | 3 | 4 | 5 | 5 | 5 | 5 | 5 | 5.56 |
| Total | | 336 | 5 | 7 | 8 | 10 | 13 | 17 | 19 | 21 | 21 | 23 | 25 | |
| Average Percent | | | 1 | 2 | 2 | 3 | 4 | 5 | 6 | 6 | 6 | 7 | 7 | 7.44 |
| A | 1 | 108 | 2 | 5 | 7 | 8 | 8 | 8 | 8 | 10 | 10 | 10 | 12 | 11.11 |
| | 2 | 95 | 0 | 5 | 5 | 6 | 7 | 7 | 9 | 11 | 12 | 12 | 16 | 16.84 |
| | 3 | 86 | 3 | 6 | 8 | 8 | 10 | 10 | 11 | 11 | 12 | 12 | 13 | 15.12 |
| | 4 | 96 | 2 | 3 | 5 | 6 | 9 | 11 | 11 | 14 | 16 | 17 | 17 | 17.71 |
| Total | | 385 | 7 | 19 | 25 | 28 | 34 | 36 | 39 | 46 | 50 | 51 | 58 | |
| Average Percent | | | 2 | 5 | 6 | 7 | 9 | 9 | 10 | 12 | 13 | 13 | 15 | 15.06 |
| B | 1 | 80 | 4 | 5 | 7 | 7 | 8 | 8 | 9 | 9 | 9 | 10 | 11 | 13.75 |
| | 2 | 100 | 2 | 4 | 5 | 6 | 7 | 10 | 11 | 11 | 11 | 12 | 12 | 12.00 |
| | 3 | 87 | 2 | 2 | 3 | 4 | 5 | 5 | 6 | 6 | 6 | 6 | 7 | 8.04 |
| | 4 | 91 | 2 | 4 | 5 | 6 | 6 | 6 | 7 | 7 | 7 | 9 | 10 | 10.99 |
| Total | | 358 | 10 | 15 | 20 | 23 | 26 | 29 | 33 | 33 | 33 | 37 | 41 | |
| Average Percent | | | 3 | 4 | 6 | 6 | 7 | 8 | 9 | 9 | 9 | 10 | 11 | 11.45 |
| C | 1 | 79 | 6 | 8 | 8 | 8 | 8 | 8 | 8 | 8 | 8 | 9 | 10 | 12.66 |

TABLE 1-continued

| Sample | Replicate | Number of Mosquitoes | Mosquitoes Repelled at Five-Minute Time Intervals (20 Minutes Post Exposure) Cumulative Number of Mosquitoes Repelled at Indicated Minutes 10 | 15 | 20 | 25 | 30 | 35 | 40 | 45 | 50 | 55 | 60 | Overall Percent |
|---|---|---|---|---|---|---|---|---|---|---|---|---|---|---|
| | 2 | 86 | 3 | 5 | 5 | 6 | 6 | 6 | 6 | 6 | 7 | 7 | 8 | 9.30 |
| | 3 | 92 | 2 | 4 | 4 | 5 | 7 | 7 | 7 | 7 | 7 | 7 | 8 | 8.70 |
| | 4 | 91 | 0 | 1 | 1 | 2 | 2 | 2 | 4 | 6 | 7 | 7 | 9 | 9.89 |
| Total | | 348 | 11 | 18 | 18 | 11 | 23 | 23 | 25 | 27 | 29 | 30 | 35 | |
| Average Percent | | | 3 | 5 | 5 | 6 | 7 | 7 | 7 | 8 | 8 | 9 | 10 | 10.06 |

The results of this experiment show that the candle containing the Methylheptenone-Coumarin-Indole composition (2.5% of the total weight) is about 40% more efficacious from an insect repellency standpoint than a candle containing 10% citronella oil . . . and in addition, such candles containing the methylheptenone-coumarin-indole composition on burning yield an aesthetically pleasing scent which is totally unlike the 10% citronella oil containing candle which yields an aesthetically displeasing scent.

EXAMPLE V

The following composition is preferred:

| Ingredient | Parts by Weight |
|---|---|
| (i) Paraffin wax | Between 90 and 99 |
| (ii) Perfuming insect repellent composition | From 1 up to 10 |

The paraffin wax is intimately admixed at 75° C. and normal atmospheric pressure with the perfuming-insect repellent composition. After one hour of mixing the resulting mixture is poured into candle molds containing wicks. The resulting candles, on use, are tested for their perfumant qualities and are tested for their insect repelling qualities. The following candles are prepared:

(a) Untreated candle only containing paraffin wax;
(b) Candle containing 10% citronella oil in addition to 90% paraffin wax;
(c) Candle containing 1% 2-methyl-3-hepten-6-one in addition to 99% paraffin wax;
(d) Candle containing 0.16% coumarin in addition to 99.84% paraffin wax;
(e) Candle containing 0.08% Indole in addition to 99%.92% paraffin wax;
(f) Candle containing 1% 2-methyl-3-hepten-6-one; 0.16% coumarin and 0.08% Indole in addition to 98.76% paraffin wax;
(g) Candle containing 1.5% citronella oil in addition to 98.5% paraffin wax;
(h) Candle containing 5% by weight of a fragrance/insect repellent composition which fragrance/insect repellent composition contains the following ingredients:

| | Ingredients | Parts by Weight |
|---|---|---|
| (A) | 50% by Weight of the following mixture: | |
| | L-Citronellal | 24.0 |
| | Geraniol | 22.0 |
| | Nerol | 8.0 |
| | Phenylethyl alcohol | 3.0 |
| | Geranyl formate | 3.5 |
| | Geranyl acetate | 3.8 |
| | Eugenol | 1.5 |

-continued

| | Ingredients | Parts by Weight |
|---|---|---|
| | Alpha Farnesene | 3.5 |
| | Beta Farnesene | 4.4 |
| | Citral | 4.2 |
| | n-Nonanal | 4.0 |
| | n-Octanal | 3.8 |
| | Trans-trans-delta-damascone | 0.8 |
| and (B) | One of: (i) 50% by Weight of the following mixture: | |
| | 2-methyl-3-hepten-6-one | 19.0 |
| | Coumarin | 3.3 |
| | Indole | 0.3 |

(ii) 50% by Weight of 2-Methyl-3-Hepten-6-one
(iii) 50% by Weight of Coumarin or

(I) MOSQUITO REPELLENCY TEST

The candles produced in the immediately proceding paragraph were tested in accordance with the procedure of Example IV, supra, thusly:

Materials

Test Chamber

The evaluation was conducted in a 28.3-cub m chamber with airing ports. A screened cage measuring 15 cm×15 cm×47.5 cm was attached inside an upper airing port, and a screened repellency observation cage measuring 15 cm×15 cm×32.5 cm was attached outside the upper airing port. The two cages were held together by a Masonite plate which fit firmly in the airing port. A 4-cm hole located in the center of each Masonite plate provided an escape for the test insects. A barrier was used to close the hole.

Attractant

A caged mouse was used as an attractant and was placed inside the chamber in the larger section of the repellency cage.

Test Insect

Adult female mosquitoes, *Aedes aegypti L.*, are the test insects.

Procedure

For each replicate, 75 to 100 adult female mosquitoes were removed from the rearing cage by means of a vacuum aspirator, and transferred by carbon dioxide anesthesia to the inner cage containing the mouse. The assembled cage was placed in one of the upper ventilation ports of the chamber.

For each experimental situation the test insects were transferred to a clean cage containing the mouse. A mosquito candle was placed centrally on the chamber floor and burned for 20 minutes before initiating the repellency counts. The maximum period for the repellency counts was 60 minutes. The first repellency count was made at 10 minutes after the burning ended, and subsequent counts were taken at 5-minute intervals thereafter. The number of mosquitoes repelled were those escaping to the outside cage. For the control, counts were made in a similar manner, but no candle was burned.

The same three candles were used for all four replicates. Between replicates the chamber was exhausted, the Kraft paper flooring for the chamber was replaced, and the two screened repellency cages were submerged in hot detergent water, rinsed and dried.

The following results were obtained:

The candles containing the mixture of methyl heptenone, coumarin and indole with or without other perfumant materials on the average had at least a 42% greater mosquito repellency than the candles containing no perfumant/insect repellent material or the candles containing citronella oil taken alone, methyl heptenones taken alone, indole taken alone or coumarin taken alone.

(II) PERFUMANT QUALITIES

The candles produced according to paragraph 7, supra, were lit and the environment in a 6 foot high×15 foot×15 foot closed room was tested for aroma by a panel of four individuals experienced in perfume testing. Each of the four panel members unanimously preferred the scent of the room when the candles were burned containing the mixture of methyl heptenones, coumarin and indole as opposed to all of the other candles as set forth, supra. On a scale of 0 to 10 ("0" being least preferred and "10" being most preferred), the preferences were as follows:

| Testing Substance | Rating Scale |
|---|---|
| (a) | 2 |
| (b) | 6 |
| (c) | 3 |
| (d) | 2 |
| (e) | 0 |
| (f) | 7 |
| (g) | 5 |
| (h) (i) | 10 |
| (h) (ii) | 6 |
| (h) (iii) | 5 |
| (h) (iv) | 4 |

The results in the aforementioned two paragraphs are unexpected, unobvious and advantageous in view of prior knowledge. The reason for the unexpected, unobvious, and advantageous result is, in part, probably due to the formation during the burning of the candles containing the coumarin, indole and methyl heptenone of a Shiff base according to the reaction:

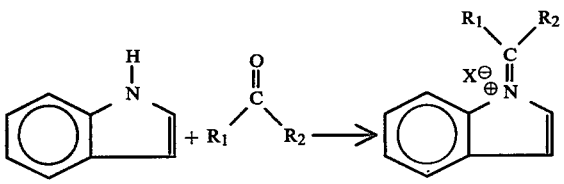

wherein the sum of the carbon atoms in $R_1$ and $R_2$ is 7 and wherein either $R_1$ or $R_2$ is a mono unsaturated alkyl moiety. Thus, for example, the reaction:

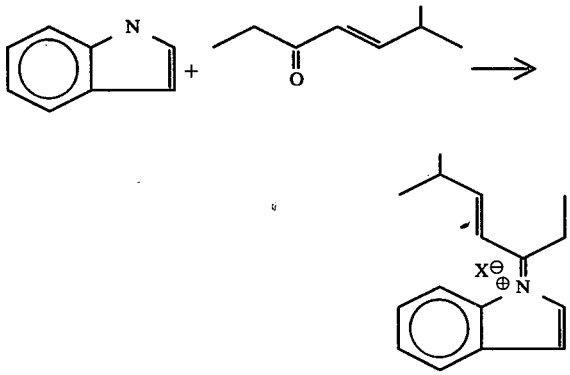

probably takes place wherein X represents hydroxyl. That is, the reaction of a methyl heptenone having the structure:

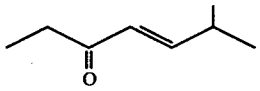

and indole having the structure:

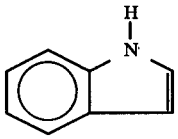

takes place during the burning of the candle, in part, whereby a Shiff base is formed which would have the structure:

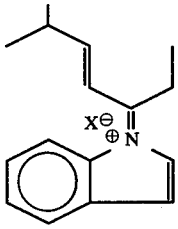

in the presence of other ingredients including a small amount of moisture present in the environment surrounding the candle and in the presence of oxygen surrounding the burning candle.

What is claimed is:

1. A candle comprising a molded hydrocarbon wax composition having a protruded wick embedded therein, said molded hydrocarbon wax composition consisting essentially of:

(a) A crystalline paraffin wax; and (b) A perfuming and insect repelling quantity of a composition of matter consisting essentially of:

(i) From 1 up to 30 parts by weight of at least one methyl heptenone having a structure selected from the group consisting of:

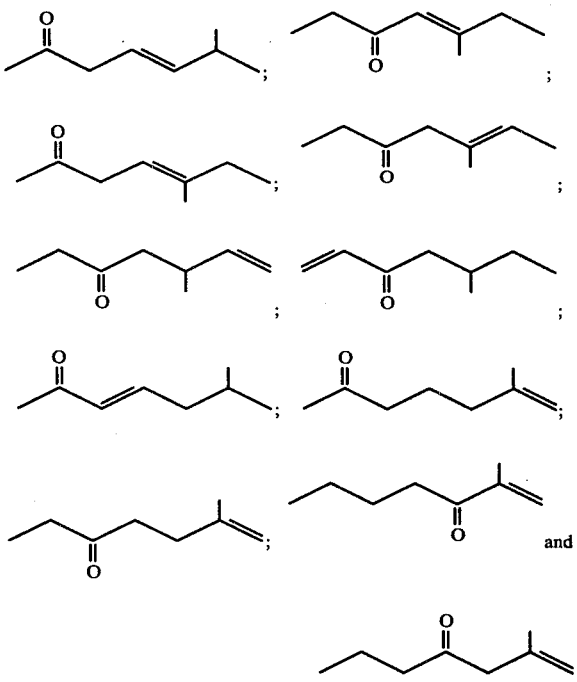

(ii) From 1 up to 10 parts by weight of coumarin; and (iii) From 1 up to 15 parts by weight of indole.

2. The candle of claim wherein the methyl heptenone is 2-methyl-3-hepten-5-one having the structure:

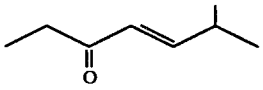

3. The candle of claim 1 wherein the perfuming insect-repelling composition consists essentially of 9 parts by weight of at least one methyl heptenone; 3.3 parts by weight of coumarin and 8.3 parts by weight of indole.

4. The candle of claim 1 containing, in addition, a non-insect-repellent perfume.

5. The candle of claim 2 containing, in addition, a non-insect repellent perfume.

6. The candle of claim 3 containing, in addition, a non-insect repellent perfume.

7. A process for imparting perfuming and insect repelling properties to a candle composition comprising the steps of:

(i) intimately admixing a crystalline paraffin wax with a perfuming and insect repelling quantity of a composition of matter consisting essentially of:

(a) from 1 up to 30 parts by weight of at least one methyl heptenone having a structure selected from the group consisting of

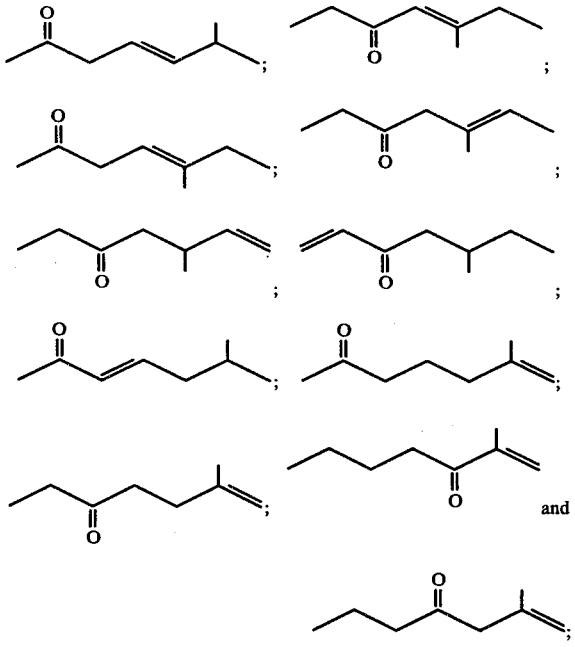

(b) from 1 up to 10 parts by weight of coumarin; and (c) from 1 up to 15 parts by weight of indole; and (ii) fabricating the resulting mixture into a candle.

8. The process of claim 7 wherein the methyl heptenone is 2-methyl-3-hepten-5-one having the structure:

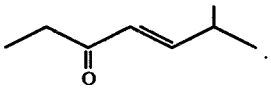

9. The process of claim 7 wherein the perfuming and insect repelling composition consists essentially of 19 parts by weight of at least one methyl heptenone; 3.3 parts by weight of coumarin and 8.3 parts by weight of indole.

10. The process of claim 7 wherein there is additionally added to the methyl heptenone-coumarin-indole mixture an additional non-insect repellent perfume prior to admixture with the paraffin wax.

* * * * *